United States Patent [19]

Ziemba et al.

[11] Patent Number: 4,567,829

[45] Date of Patent: Feb. 4, 1986

[54] SHAPED CHARGE PROJECTILE SYSTEM

[75] Inventors: Richard T. Ziemba, Burlington; Richard W. McLay, Essex Junction; Jeff A. Siewert, Monkton, all of Vt.

[73] Assignee: General Electric Company, Burlington, Vt.

[21] Appl. No.: 636,043

[22] Filed: Jul. 30, 1984

[51] Int. Cl.[4] ..... F42C 13/00; F42B 13/10

[52] U.S. Cl. ..... 102/211; 102/216; 102/397; 102/476; 102/489

[58] Field of Search ..... 102/211, 210, 216, 397, 102/476, 489

[56] References Cited

U.S. PATENT DOCUMENTS

| | | | |
|---|---|---|---|
| 2,293,817 | 8/1942 | Gruver | 102/397 |
| 3,416,449 | 12/1968 | Brothers | 102/476 |
| 3,474,731 | 10/1969 | Thomanek | 102/476 |
| 3,515,067 | 6/1970 | Min | 102/397 |
| 3,613,585 | 10/1971 | Dubroff | 102/476 |
| 3,677,179 | 7/1972 | Potteiger | 102/473 |
| 3,742,857 | 7/1973 | Schmidt et al. | 102/210 |
| 3,760,731 | 9/1973 | Gaughan | 102/476 |
| 3,844,217 | 10/1974 | Ziemba | 102/276 |
| 3,853,066 | 12/1974 | Campagnuolo et al. | 102/397 |
| 3,906,860 | 9/1975 | Johns | 102/476 |
| 4,091,733 | 5/1978 | Ziemba | 102/209 |
| 4,181,079 | 1/1980 | Klier | 102/476 |
| 4,291,627 | 7/1981 | Ziemba | 102/265 |

FOREIGN PATENT DOCUMENTS

| | | | |
|---|---|---|---|
| 1809162 | 6/1970 | Fed. Rep. of Germany | 102/397 |

*Primary Examiner*—Charles T. Jordan
*Attorney, Agent, or Firm*—Bailin L. Kuch

[57] ABSTRACT

This invention provides a subcaliber projectile which is launched from a full bore projectile having a shaped charge warhead prior to impact with the target. The subcaliber projectile is tethered to the full bore projectile by means of a fine electrical cable of fixed length which serves as the communication link between the two projectiles with the length of the cable determining the fuzing standoff distance. The ballistic coefficient of the subcaliber projectile is made such that the subcaliber projectile always flies ahead of the full bore projectile.

14 Claims, 6 Drawing Figures

SHAPED CHARGE PROJECTILE SYSTEM

BACKGROUND OF THE INVENTION

1. Field of Art

This invention relates to providing ignition to a shaped charge projectile at an appropriate stand-off distance from the target.

2. Prior Art

Mechanisms for providing stand-off for a shaped charge projectile are well known in the prior art. A rigid forward extension which places a contact mechanism, such as a piezoelectric crystal, a distance forward of the shaped charge is shown in U.S. Pat. No. 3,416,449, issued Dec. 17, 1968, to J. Brothers; U.S. Pat. No. 3,474,731, issued Oct. 28, 1969, to F. R. Thomanek; U.S. Pat. No. 3,613,585, issued Oct. 19, 1971, to S. Dubroff; U.S. Pat. No. 3,760,731, issued Sept. 25, 1973, to G. E. Gaughan etal; U.S. Pat. No. 3,906,860, issued Sept. 23, 1975, to W. H. Johns and my U.S. Pat. No. 4,291,627, issued Sept. 29, 1981.

A bellows structure which is inflated during flight, by a not disclosed timing mechanism, to place a contact mechanism a distance forward of the shaped charge is shown in U.S. Pat. No. 4,181,079, issued Jan. 1, 1980, to H. Klier et al. A coaxial tube structure which is extended during flight by airdrag retarding the outermost tube, but not in in a shaped charge application, is shown in U.S. Pat. No. 3,677,179, issued July 18, 1972, to L. A. Potteiger.

Mechanisms for instructing fuzes, particularly timing circuits, during flight as shown in my U.S. Pat. No. 3,844,217, issued Oct. 29, 1974 and in others, including U.S. Pat. No. 4,291,627.

SUMMARY OF THE INVENTION

It is an object of this invention to provide a mechanism for an extended fuzing stand-off for a shaped charge warhead.

A feature of this invention is the provision of a subcaliber projectile which is launched from a full bore projectile having a shaped charge warhead prior to impact with the target. The subcaliber projectile is tethered to the full bore projectile by means of a fine electrical cable of fixed length which serves as the communication link between the two projectiles with the length of the cable determining the fuzing standoff distance. The ballistic coefficient of the subcaliber projectile is made such that the subcaliber projectile always flies ahead of the full bore projectile.

BRIEF DESCRIPTION OF THE DRAWING

These and other objects, advantages and features of this invention will be apparent from the following specification thereof taken in conjunction with the accompanying drawing in which.

DESCRIPTION OF THE INVENTION

The invention is based upon the premise that two projectiles of substantially different dimensions can be made to have nearly identical aeroballistic characteristics, and as such, can be made to fly matched ballistic trajectories. A further aeroballistic refinement is then made in the smaller of the two projectiles to allow it to fly a slightly faster trajectory than the larger projectile. If then, the two projectiles are gun launched together, where the smaller projectile is carried by the larger projectile and then the two are made to separate just prior to target impact, the smaller projectile, with its better ballistic characteristics, will fly slightly ahead of the larger projectile from which it is launched. If further, the two projectiles are tethered together by means of a thin, short length wire, they will fly to the target with the wire taut, representing a fixed separation between the two projectiles. If now the lead projectile carries a piezoelectric crystal in its nose to serve as a crush up sensor, and the wire connecting the two projectiles is designed to carry the electrical impulse from this crystal to a fuze in the "follow" projectile, then target impact by the lead projectile will cause the shaped charge warhead in the "follow" projectile to function at a target standoff determined by the length of the connecting wire cable. In this manner it is possible to precisely fix the target standoff distance to allow optimum warhead effectiveness.

Figure 1:
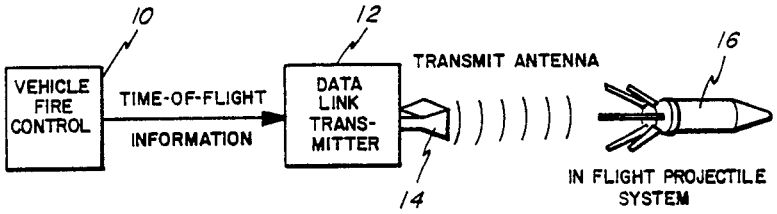
FIG. 1 is a block diagram of a weapon system embodying this invention.

FIG. 1 shows the overall weapon system including a fire control system 10 having a range finder and which may be located on the gun turret or the vehicle and which is coupled to a RF data link transmitter 12 having a transmit antenna 14 which transmits fuze time setting data to the inflight projectile system 16.

Figure 2:
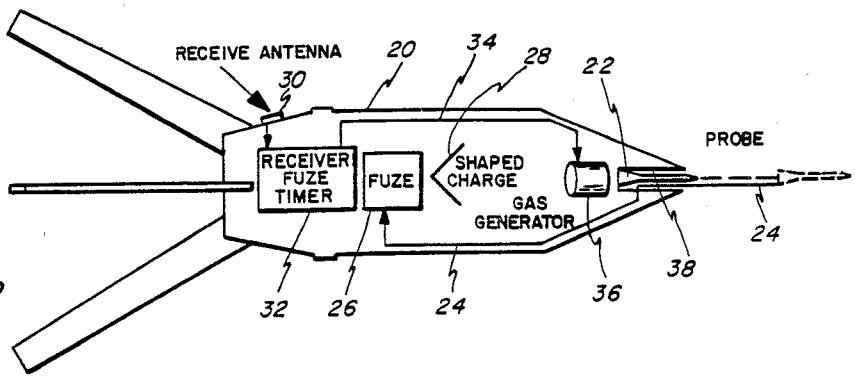
FIG. 2 is a functional schematic of the projectile system of FIG. 1.
Figure 3:
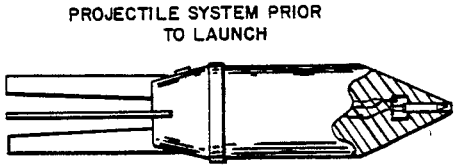
FIG. 3 is a perspective view of this projectile system of FIG. 2 prior to launch.

FIG. 2 shows the inflight projectile system including a full bore projectile 20 carrying a subcaliber projectile or probe 22 coupled by a fine, two conductor wire 24 to a base fuze 26 which is disposed behind a shaped charge 28. A receive antenna 30 is coupled to a receiver and fuze timer 32 whose output is coupled by a conductor 34 to a pyrotechnic gas generator or dimple motor 36 having an electrical initiator 37 which is able to eject the probe 22 from the recess 38 in which it is initially disposed.

The transmitter and receiver electronics are similar to those shown in U.S. Pat. No. 3,844,217, to which reference for details should be made. The time set into the receiver and fuze timer 32 is its exact instant along the trajectory of the projectile 20 that the probe 22 is to be deployed. At that time, the output of the fuze timer causes the motor 36 to eject the probe 22. This time is a few hundred milliseconds prior to impact with the target.

Figure 4:
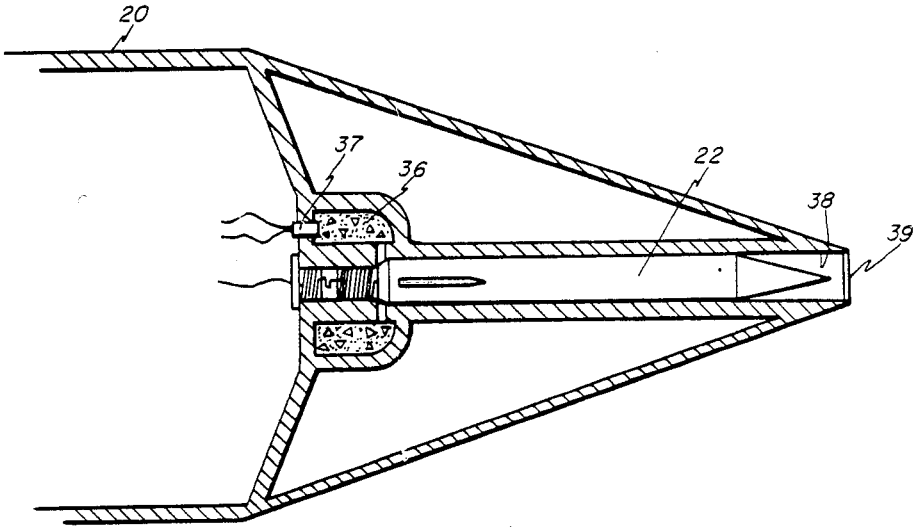
FIG. 4 is a detail view of the projectile system of FIG. 3.

As shown in FIG. 4, the opening of the recess 38 is sealed against the environment by means of a thin metal foil 39 which is torn away as the probe is ejected. The insulated cable 24 connecting the projectile base fuze 26 to the probe 22 provides the communication link between the probe 22 and the projectile 20. The fuze conventionally contains a set-back generator 40, which may be of the type shown in my U.S. Pat. No. 4,091,733, issued May 30, 1978, a diode 42, an inertial switch (trembler) 44, a capacitor 52 and a detonator 54. An ogival crush-up switch 46, which may be of the type shown in U.S. Pat. No. 4,291,627, is in the projectile 20 and in parallel with the inertial switch (trembler) 44 in the base fuze 26, and closure of any of these switches will cause the warhead to function.

Figure 6:
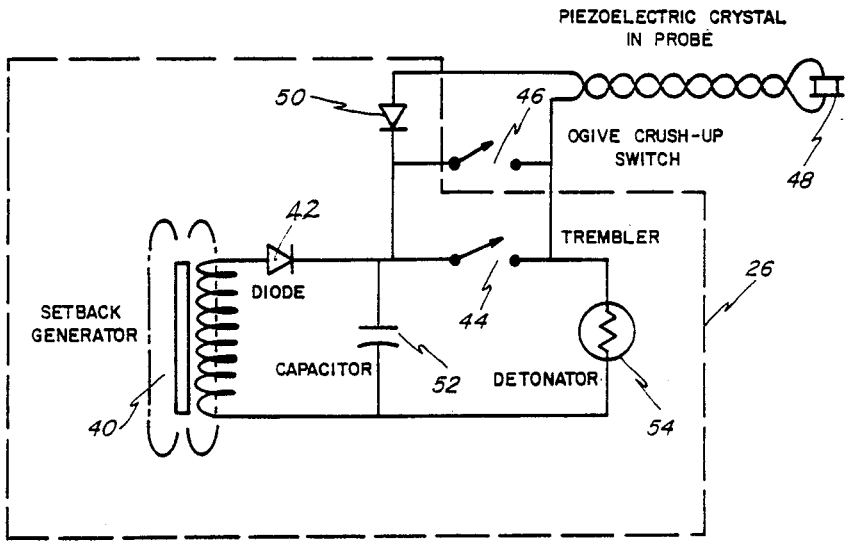
FIG. 6 is a schematic of the electrical fuze system.

A piezoelectric crystal 48 is encased within the probe and a series diode 50 is added within the fuze 26 as shown in FIG. 6. The probe will function the fuze 26 when it has impacted a target and the crystal 48 has generated a high voltage spike which passes through the blocking diode 50, and in discharging the fuze capacitor 52, functions the fuze detonator 54. An inadvertent short circuit of the connecting cable from the probe to the projectile fuze will not cause the warhead to function. This feature prevents a premature function of the round in the event the connecting cable is damaged (shorted), by whatever means, prior to target impact.

Figure 5:
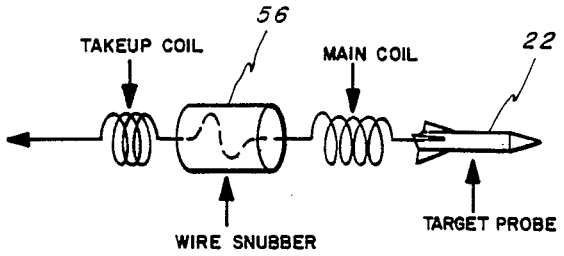
FIG. 5 is functional schematic of the detail shown in FIG. 4.

As shown in FIG. 5, the wire 24 is stowed in a cavity behind the probe and is extracted from the cavity as the probe is accelerated forward of the projectile. The last few inches of wire is passed through a drag brake (snubber) 56 to limit tension on the line as the probe approaches its fully extended position.

The projectile 20 may be a 105 mm, fin stabilized, high length-to-diameter ratio dart. The projectile 20 decelerates more rapidly than the probe 22 due to its higher drag. Fired at identical velocities at the same instant, the probe will always reach the target before the projectile.

We claim:

1. A round of ammunition of the type fired from a projectile launching device on a ballistic trajectory comprising:

a first projectile having
a shaped charge, and
a fuze for igniting said shaped charge;

a second projectile coupled to said first projectile and having less drag than said first projectile and means for activating said fuze to ignite said shaped charge.

2. A round according to claim 1 wherein said projectile launching device is a gun.

3. A round according to claim 2 wherein:

said second projectile is initially carried by said first projectile, and said first projectile includes
means subject to control from a signal originated remotely from said round for deploying said second projectile from and forwardly of said first projectile.

4. A round according to claim 3 wherein:

said second projectile is inter-coupled to said first projectile by a communications cable of fixed length, and which length determines the maximum spacing between said projectiles.

5. A round according to claim 4 wherein:

said second projectile is adapted to develop less aerodynamic drag than said first projectile, whereby after development from said first projectile, said second projectile flies at a higher velocity than said first projectile until limited to the velocity of said first projectile by said fixed length of said cable.

6. A round according to claim 5 wherein:

said second projectile fuze activating means is disposed in the nose of said second projectile and said means generates a signal, upon contacting a target, which is coupled via said communications cable to said fuze to activate said fuze to ignite said shaped charge before said first projectile strikes said target.

7. A round according to claim 5 wherein:

said second projectile fuze activating means is a piezoelectric crystal.

8. A weapon system comprising:

a round of ammunition including a first projectile having
a shaped charge, and
a fuze for igniting said shaped charge;

a second projectile coupled to and initially carried by said first projectile and having
means for activating said fuze to ignite said shaped charge;

said first projectile further including
means for deploying said second projectile from and forwardly of said first projectile; and control means, remote from said round of ammunition, for signaling to said first projectile the time of flight at which said deploying means is to deploy said second projectile.

9. A weapon system according to claim 8 wherein:

said second projectile is inter-coupled to said first projectile by a communications cable of fixed length, and which length determines the maximum spacing between said projectiles.

10. A round according to claim 9 wherein:

said second projectile is adapted to develop less aerodynamic drag than said first projectile, whereby after deployment from said first projectile, said second projectile flies at a higher velocity than said first projectile until limited to the velocity of said first projectile by said fixed length of said cable.

11. A round according to claim 10 wherein:

said second projectile fuze activating means is disposed in the nose of said second projectile and said means generates a signal, upon contacting a target, which is coupled via said communications cable to said fuze to activate said fuze to ignite said shaped charge before said first projectile strikes said target.

12. A weapon system comprising:

a gun;

a round of ammunition, for being fired from said gun on a ballistic trajectory, comprising:

a first projectile having
a charge, and
a fuze for igniting said charge;

a second projectile coupled to said first projectile and having
less aerodynamic drag than said first projectile, and
means for activating said fuze to ignite said charge;

said second projectile being initially carried by said first projectile, and said first projectile including
means for receiving a signal originated remotely from said round and for thereupon deploying said second projectile from and forwardly of said first projectile.

13. A weapon system according to claim 12 wherein:

said second projectile is inter-coupled to said first projectile by a communications cable of fixed length, and which length determines the maximum spacing between said projectiles.

14. A process of detonating a shaped charge in a first projectile at a predetermined distance from a target comprising:

providing said first projectile with a second projectile which is coupled to said first projectile by cable means of a length equal to said predetermined distance;

providing said second projectile with relatively less aerodynamic drag than said first projectile;

disposing said second projectile on board said first projectile;

accelerating said first and on board second projectile along a ballistic trajectory;

from a position which is remote from said first and on board second projectile, signaling said projectiles to separate, whereupon said second projectile flies at a higher velocity than said first projectile until limited to the velocity of said first projectile by said length of cable means;

said second projectile upon impacting the target causing said shaped charge in said first projectile to thereupon detonate.

* * * * *